United States Patent [19]

Rojas

[11] 4,232,204

[45] Nov. 4, 1980

[54] HIGH FIDELITY LOUDSPEAKER

[75] Inventor: Hernan H. Rojas, Santiago, Chile

[73] Assignee: Comercial e Industrial Sound-Tronic Ltd., Santiago, Chile

[21] Appl. No.: 917,886

[22] Filed: Jun. 22, 1978

[51] Int. Cl.[2] ..... H04R 9/06

[52] U.S. Cl. ..... 179/115.5 R; 179/115.5 PS; 179/115.5 VC

[58] Field of Search ..... 179/115.5 R, 181 R, 179/181 F, 115.5 PS, 115.5 VC; 181/163, 164, 165, 167, 168, 169, 170, 173, 174

[56] References Cited

U.S. PATENT DOCUMENTS

| | | | |
|---|---|---|---|
| 3,114,429 | 12/1963 | Miner | 181/163 |
| 3,117,301 | 4/1965 | Hecht | 199/115.5 R |
| 3,906,171 | 9/1975 | Braceley | 179/115.5 VC |

FOREIGN PATENT DOCUMENTS

| | | | |
|---|---|---|---|
| 1003608 | 9/1965 | United Kingdom | 181/167 |

*Primary Examiner*—James W. Moffitt
*Attorney, Agent, or Firm*—Brisebois & Kruger

[57] ABSTRACT

The loudspeaker includes a front panel of expanded polystyrene resiliently connected to side walls of the speaker enclosure. A standard loudspeaker is connected to the front panel, and there is a small diffuser cone concentric with the standard cone. The front panel is driven by the standard cone to reproduce low and medium frequencies and the diffuser cone reproduces high frequencies. Both speakers are driven by a common driver fixed to a rear panel or cross-beam of the enclosure.

3 Claims, 4 Drawing Figures

HIGH FIDELITY LOUDSPEAKER

The present invention relates to a new system of acoustic box or high fidelity loudspeaker.

The new system disclosed in this specification relates to the placement in a single indivisible unit the acoustic box, the three loudspeakers (Woofer, Mid-range and Tweeter) and the frequency divider circuit.

Between the system of the present invention and the prior art systems exists similar differences as the ones existing between an "integrated electronic circuit" and a "standard circuit" comprising transistors, resistors, capacitors, coils and other elements.

The main difference between the acoustic system of the invention and the conventional systems resides in that the system of the invention is conceived and constructed in two parts which, once assembled, constitute one indivisible unit. These two parts are the box or outer cover, with the driving magnet in the rear portion of the box, and the radiator panel, which includes the speakers cones, the driving coil and the suspension system.

The system of the invention provides the following advantages:

Frequency response higher than the conventional boxes of similar size.

High electroacoustic conversion performance, allowing the reduction of the amplifier capacity to any given sound pressure level.

Coherent sound without phase distortion because the sound emerges from a single radiator.

High reproduction quality.

Frequency linearity in the complete range because the three ways are electromechanically produced thus preventing the dead spaces characteristical of the crossovers.

The low frequency range has a subsonic response which makes the system of the invention equivalent to a conventional speaker of a very high quality and price.

Having no "crossover", the performance is higher than in conventional systems, because these discriminating circuits always carry out insertion losses and the impedance that the speaker presents to the amplifier system is less complex (being much similar than a resistive load) which is less demanding as regards the stability of the amplifier.

As the panel is highly efficient in the acoustic conversion throughout the whole audible range, the heat developed in the driving coil is minimal and practically all the power applied is converted into sound, thus providing a clear advantage in regard to duration over the conventional systems.

The operating system provides a very thin construction design which could be simulated into "picture frames" for wall hanging.

The main advantage of the invention is the fact that the proposed system is a high fidelity system compatible with every type of sound playing and amplifying equipments, with a very low manufacturing cost compared with its high sound quality.

The speaker's system of the invention comprises a frame made of wood (or a suitable plastic material) playing "no acoustic function" and without front panel, thus eliminating the high cost involved in the grooving and machining of said front panel.

The rear portion of the frame can be open or covered with a cloth or with a perforated thin wood board.

The driving magnet is mounted in the frame by means of a metal bar or strip which is fixed to the frame with screws or other suitable means.

A conventional acoustic system equivalent to the system of the invention comprises the following elements:

A wooden box machined in its front part to accomodate the three loudspeakers in a rigid and air thight mounting.

A woofer.

A tweeter.

A mid-range.

A cross-over.

A connecting plug between the "cross-over" and the outer part of the box.

A front cloth and frame.

As is known in the art, the conventional acoustic systems comprise three driving magnets to reproduce the complete audible range of music or words.

The system of the invention uses only one driving magnet to energize the front panel which, due to its novel construction, is capable of reproducing the whole audible range of the music or words.

The construction features of the front panel and the coupling of only one cone to said polystyrene panel, besides the novel use of a spreading cone enables the panel to mechanically discriminate the frequencies and to reproduce the whole range of frequencies with greater effectiveness than ordinarily in the low frequency zone, due to its large useful area.

The system of the invention having the "woofer", the "mid-range" and the "tweeter" positioned in a concentric arrangement and practically in a same level produces a phase distortion smaller than that being produced in a three way conventional system having three speakers arranged one by the other.

The system of the invention uses a single large driving magnet similar to the magnet used in the "woofer" of a conventional system.

Usually, the magnets used for the "mid-range" and "tweeters" in conventional system are much smaller than the magnet used in the "woofers", taking advantage of the fact that the former handle les power than the later.

Nevertheless, it is a proven fact that the larger the magnet the smaller the distortion the speaker will produce—even with very small power levels—and the bigger its electro-acoustic performance.

Consequently, the distortion of the mid-range and high frequencies in the system of the invention is surprisingly smaller than the distortion of an equivalent conventional design and its performance throughout the mentioned range is much greater: in the medium and high range due to the large magnet utilized, and in the low frequency range the panel having an area many times larger than that of a conventional "woofer" is also more effective, all of which results in a well balanced response of greater sound pressure.

The invention will be described with reference to the accompanying drawings in which.

Figure 1:
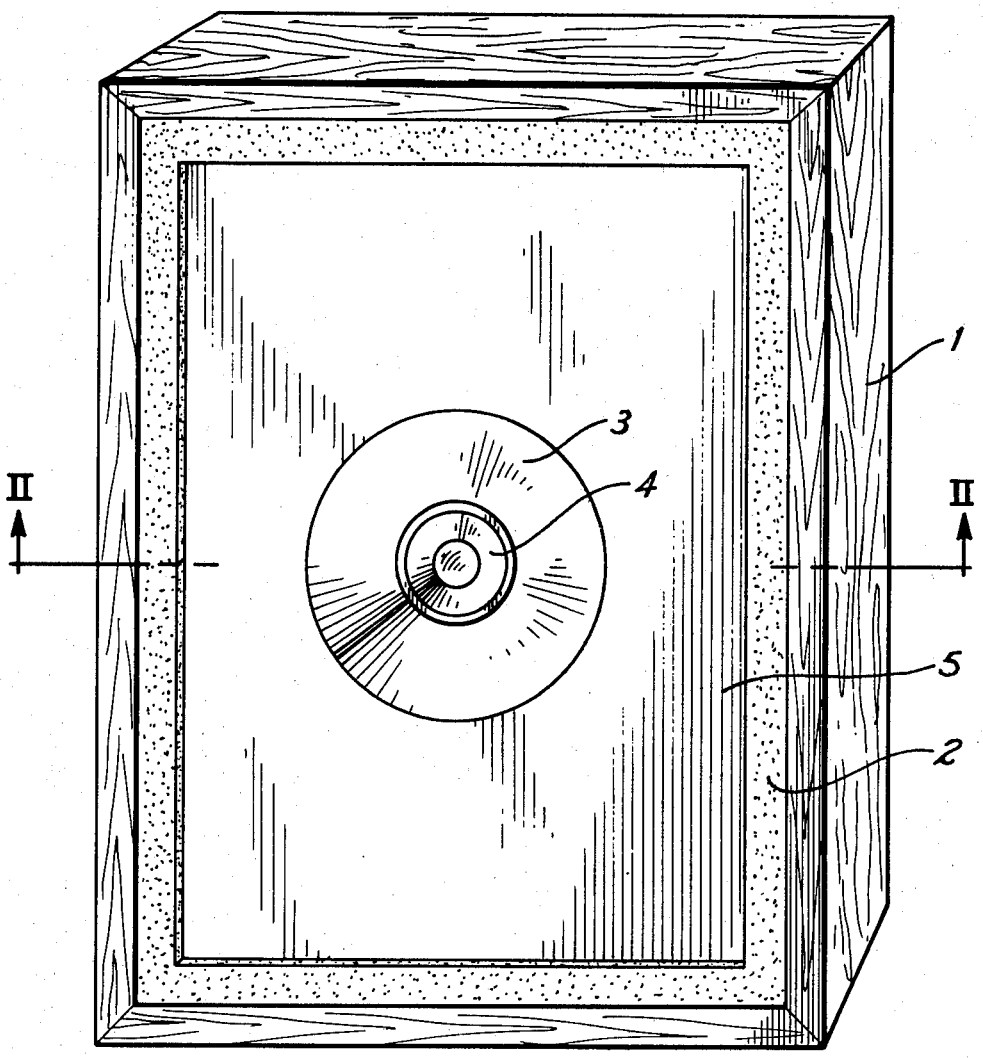
FIG. 1 is a perspective front view of an acoustic box comprising the invention.

In FIG. 1 it is illustrated an acoustic box according to the invention, comprising a box (1), a suspension system (2) made of a resilient material, a medium frequencies reproducer (3), a high frequencies reproducer (4) and a low frequencies reproducer plate (5).

Figure 2:
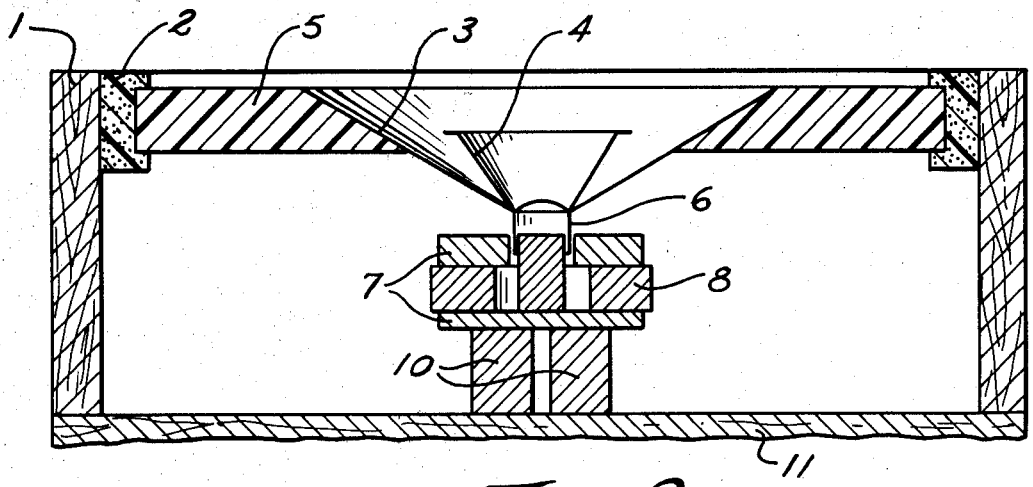
FIG. 2 is a cross-sectional view, taken along line II—II of FIG. 1.

As shown in FIG. 2, the sound radiator system comprises a rectangular panel made of expanded polystyrene (5) (or other material having a high stiffness to mass ratio) in the center of which is provided a frustroconical opening.

To the conical walls of said opening if affixed, by means of a suitable adhesive agent, a standard loudspeaker cone (3) which in its bottom end is provided with a driving coil (6).

The movement of said driving coil (6) produces the corresponding vibration of the cone walls (3) which in turn are transmitted to the expanded polystyrene panel (5).

Said panel (5) is connected to the side walls (1) of the frame or box by means of a suitable strip of polyurethane foam (or other resilient material) allowing a flexible connection to provide a certain degree of movement to the panel (5) under the action of the vibrations of cone (3) (see FIG. 2).

Said panel (5) together with cone (3) and driving coil (6) conforms the low and medium frequencies reproducer system. For high frequency reproduction, a small cone (4) (or "Tweeter") is directly connected to the driving coil (6) (see FIG. 2).

By varying the relative desities of the expanded polystyrene used for the front panel (5) and of the cellulosic paper used for the reproducer cones (3) and (4), as well as their size ratios, an equilibrium of the response of the three mentioned elements can be obtained to provide a linear response in the whole system.

Figure 3:
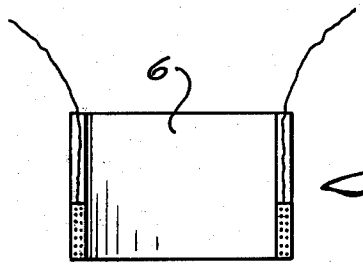
FIG. 3 illustrates the driving coil of the loudspeakers system.

The driving coil (6) is of a small size and is manufactured with the copper wire embedded in a tube made of a thermosetting material to provide a high resistance to heat and strains (FIG. 3).

Figure 4:
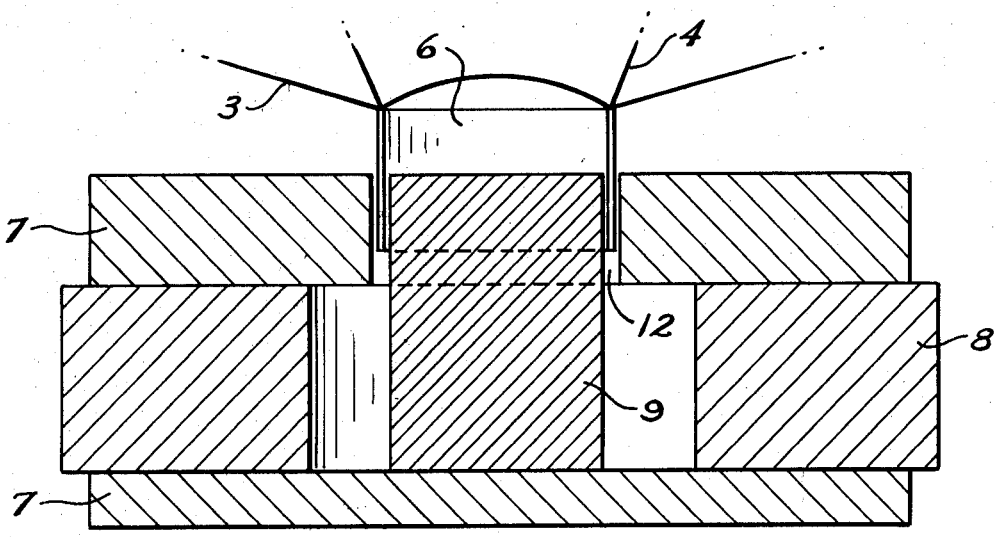
FIG. 4 illustrates the magnetic system used in the system of the invention.

The magnetic driving system comprises a "Ferrite" ring (8) with respective metallic polar pieces (7) (FIGS. 2 and 4).

To provide a higher concentration of the magnetic field a small size driving coil (6) is used, together with a small air gap (12) between the polar piece and the center polar piece (9). Furthermore, the air gap (12) is very long thus ensuring that the driving coil (6) even during its maximum range of displacement should be fully inmersed in the magnetic field, providing an excellent response linearity of the system at all frequencies.

The wooden frame (1) is designed to support the radiant panel (5) and the magnet assembly and its main dimensions are determined only by esthetical but "not acoustic considerations" (FIGS. 1 and 2).

In the case of a front panel having a length of 50 cm (20 in) and a width of 40 cm (16 in), with a front area of about 2000 $cm^2$ (320 sq. in), it is normally used in connection with an 8 in. loudspeaker (useful area about 150 $cm^2$).

As the efficiency of a low frequencies reproducer is proportional to the volume of air that can it is able to displace, it is evident that in the system of the invention—if we suppose equal displacements—the efficiency is at least ten times higher than in the conventional systems.

The reproduction of the medium frequency sounds is provided by the loudspeaker cone (3) that is fixed to the polystyrene front panel (5).

The reproduction of the high frequency sounds is provided by the small diffuser cone (4) that is directly connected to the driving coil (6).

In a frequency sweep analysis it has been observed that the polystyrene panel (5) is a very good low frequency radiator, which is not activated when subjected to medium or high frequencies.

The standard cone (3) provides a good response to medium frequencies which in the low frequency range actuates only as a driver for the polystyrene pael (5) without being activated by the high frequency range.

The small diffuser cone (4) is capable for reproducing the complete frequency range, but due to its particular shape and size its efficiency is enhanced only in the high frequency range.

From the above it is therefore evident that the three mentioned elements (panel, standard cone and tweeter) conform and define a novel three way system.

The principal advantage of the system of the present invention resides in the fact that it provides an excellent low frequency response as it is highly efficient in this particular range of the audible spectrum, which added to its high efficiency in all the audible range provide an improved apparatus having an improved sound quality in comparison with the conventional acoustic boxes of the prior art.

I claim:

1. An acoustic box having side walls connected to a front panel through a resilient suspension, said front panel being made of expanded polystyrene and associated with a standard loudspeaker cone and a small diffuser cone which are concentric and are driven by a single common driving coil, said front panel operating as a low frequency reproducer, said standard cone operating as the panel driving means for the low frequency range and also as a reproducer for the medium frequencies, and the smaller diffuser operating as a high frequency reproducer, the whole arrangement conforming to an indivisible system and as an electro-acoustical transducer having a linear response in the audible range, and wherein the driving coil is embedded in a moulded plastic tube to prevent deformation, and said driving coil is permanently immersed in a magnetic field.

2. An acoustic box having side walls connected to a front panel through a resilient suspension, said front panel being made of expanded polystyrene and associated with a standard loudspeaker cone and a small diffuser cone which are concentric and are driven by a single common driving coil, said front panel operating as a low frequency reproducer, said standard cone operating as the panel driving means for the low frequency range and also as a reproducer for the medium frequencies and the small diffuser operating as a high frequency reproducer, the whole arrangement conforming to an indivisible system and as an electro-acoustical transducer having a linear response in the audible range, and wherein a driver magnet is directed connected to a cross-beam of the box, thus eliminating the conventional loudspeaker housing bell.

3. An acoustic box comprising a front panel made of a material of a high stiffness to mass ratio associated to a standard loudspeaker cone and a small diffuser cone which are concentric and are driven by a single common driving coil, said front panel operating as a low frequency reproducer, said standard cone operating as the panel driving means for the low frequency range and also as a reproducer for the medium frequencies and the small diffuser cone operating as a high frequency reproducer, the whole arrangement conforming to an indivisible system and as an electro-acoustical transducer having a linear response in the audible range, said front panel being connected to side walls of the box through a resilient suspension, and wherein the material of said front panel is expanded polystyrene.

* * * * *